US006402528B2

(12) United States Patent
Takahashi et al.

(10) Patent No.: US 6,402,528 B2
(45) Date of Patent: Jun. 11, 2002

(54) ELECTRONIC PART MOUNTING DEVICE

(75) Inventors: Hideyuki Takahashi, Gotenba; Toyokazu Ezura, Kawasaki, both of (JP)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/850,622

(22) Filed: May 7, 2001

Related U.S. Application Data

(63) Continuation-in-part of application No. 09/694,636, filed on Oct. 23, 2000, now Pat. No. 6,287,127.

(51) Int. Cl.[7] ..... H01R 12/00
(52) U.S. Cl. ..... 439/70
(58) Field of Search ..... 439/70, 73, 331, 439/342, 266

(56) References Cited

U.S. PATENT DOCUMENTS 4,468,072 A 8/1984 Sadigh-Behzadi ..... 439/266
5,147,213 A 9/1992 Funk et al. ..... 439/266
5,807,127 A 9/1998 Ohshima ..... 439/266
5,989,039 A * 11/1999 Sik ..... 439/73
6,027,355 A 2/2000 Ikeya ..... 439/268
6,050,836 A 4/2000 Tohyama ..... 439/266
6,106,319 A * 8/2000 Fukunaga et al. ..... 439/342
6,126,467 A 10/2000 Ohashi ..... 439/268
6,149,449 A * 11/2000 Abe ..... 439/268

* cited by examiner

*Primary Examiner*—Tulsidas Patel
(74) *Attorney, Agent, or Firm*—Russell E. Baumann; Fredrick J. Telecky, Jr.

(57) ABSTRACT

An electronic part mounting device including a main socket body (2) having a plurality of contact parts (7) mounted therein for making contact with a plurality of contact terminals (10*a*) on an electronic part (10). Main socket body (2) is adapted to work with a contact opening and closing tool (3) with a holding part (34) for removably mounting and dismounting an electronic part (10) in the socket body (2) and an actuator member (30) having touch parts (32) that engages and moves a tool positioning part (52) on the socket body (2) to cause opening and closing of contacts (7).

18 Claims, 7 Drawing Sheets

ELECTRONIC PART MOUNTING DEVICE

CROSS REFERENCE TO RELATED APPLICATION

This is a continuation-in-part Ser. No. 09/694,636 of issued U.S. Pat. No. 6,287,127 filed Oct. 23, 2000,which claims priority to Japanese Patent Application No. 11(1999)-341360 filed Nov. 30, 1999. This application claims priority to Japanese Patent Application No. 2000-1475333 filed May 19, 2000.

FIELD OF THE INVENTION

This invention relates generally to a mounting device for electrically connecting an electronic part and each of its terminals to a substrate board for testing.

BACKGROUND OF THE INVENTION

Often, integrated circuit (IC) chips which are sealed in resin after their manufacture are subjected to a reliability testing called a burn-in test and/or an electric properties test prior to their shipment to distinguish between satisfactory product and unsatisfactory product.

Such an electric properties test, tests the input and output characteristics of the IC chips, pulse characteristics and noise leeway, etc. In the burn-in test, IC packages are arranged in an oven and then functionally tested for a selected period of time at an elevated temperature and voltage level (e.g., 125° C. at 120% of normal voltage level). Only those that pass these tests are shipped out as satisfactory products.

One common package in use today is a BGA (Ball Grid Array) package with connective terminals made up of globular solder balls arranged in a matrix or zigzag fashion on the underside of the package. The advantages of this BGA package design exists in having wider connective terminal pitches while the outside dimensions are small and the connective terminals are strong.

FIGS. 7(*a*) and 7(*b*) show a prior art socket for the burn-in test built for mounting a BGA package. The socket 101 has a square-shaped base 102 made of a plastic resin or the like, on which a slider member 103 is arranged in such a manner as to freely slide back and forth in the horizontal direction during the mounting of BGA package 100.

Above base 102, an attached cover 104 with an opening 104*a* is constructed so as to move up and down as compared with base 102 by the means of compressive coil springs 105. Slider 103 and base 102 are configured with through holes (not shown in the drawing) that correspond to each solder ball 100*a* of the BGA package. A plurality of contacts 106 are mounted in base 102 for compressively making electrical contact with the solder balls 100*a* of the BGA package with each contact 106 extending through the through hole of base 102 and slider 103. Each contact 106 has a centered body portion made of metal with a pair of metallic arms 106*a* and 106*b* provided at one tip thereof.

On both sides of slider 103, a slide mechanism is provided for moving the slider 103 in parallel with the bottom of base 102. The slide mechanism includes first L-shaped lever members 108 freely rotatably installed at both ends of a shaft 107 that is positioned on one edge (right-side edge in the drawings) of base 102 with a short arm portion 108*a* of lever member 108 freely rotatably linked to a shaft 109 positioned vertically below shaft 107 that touches slider 103.

Second lever members 111 are installed freely rotatably at both ends of a shaft 110 that are positioned on the other edge side of base 102 from shaft 107. At the middle of each second lever member 111, the tip of first lever member 108 is fixed in a freely swinging manner by means of a pin 112.

When the cover 104 is in the up position FIG. 7(*a*), the tip part 111*a* of second lever member 111 is so arranged as to touch a protuberant part 104*b* of cover 104. In the vicinity of shaft 110, a compressive coil spring 113 is provided in base 102 for the purpose of biasing slider 103 toward one preferred at rest position.

In a socket 101 described above, when cover 104 is pressed down from a state shown in FIG. 7(*a*) to a state shown in FIG. 7(*b*), first and second lever members 108 and 111 rotate toward base 102 and, along with the movement of lever members 108, shaft 109 engages slider 103, thereby moving it in the X-direction. As a result of this movement of slider 103, one arm 106*a* of contact 106 moves away from arm 106*b* to an open position. In this state, BGA package 100 can be placed on an adaptor 103*c* of slider 103 with each solder ball 100*a* of BGA package 100 positioned between arms 106*a* and 106*b*. When the pressure on the cover is released, first and second lever members 108 and 111 rise and the slider 103 is restored toward its original position by the force of compressive coil spring 113 with the consequence that the arms 106*a* and 106*b* are closed and each solder ball 100*a* of BGA package 100 is held by the arms of each contact. In such position, each solder ball 100*a* of package 100 and each contact 106 are electrically connected.

This socket has proved to be useful in the operation but has a large number of parts with a somewhat complex construction. It requires the movement of linking mechanisms 108, 111 and slider 103 to cause the opening and closing of arms 106*a*, 106*b* in a set sequence of operations. Moreover, socket 101 tends to be large and heavy compared to other sockets with the various moving parts subject to wear in the case of the resin slider causing wear particles in the socket.

Still further, wear between moving parts (actuator and slider) can cause powder particles which can cause failure of electronic package mounting device. Also, there can be a problem with uniformly maintaining proper contact opening distance when there is bending of the wiring substrate.

SUMMARY OF THE INVENTION

An object of the present invention is the provision of a mounting device/system which overcomes the prior art limitations described above and which prevents concomitant trouble resulting from using a drive mechanism as the cover or lever, etc., to control the movement of the contact arms.

Another object of this invention lies in providing an electronic part mounting device using a contact opening and closing tool separate from the base member and where the friction to open and close the socket contacts is reduced to increase the interval between maintenance work and particularly suitable for an electronic part mounting device with a large number of contact members.

Yet another object of this invention lies in offering an electronic part mounting device where there is uniformity in the amount of opening of the arm-shaped contact parts.

Other objects, advantages and details of the novel and improved electronic part mounting device of the present invention appear in the following detailed description of the prepared embodiments of the invention.

BRIEF DESCRIPTION OF THE DRAWINGS

FIG. 2(*b*) is an enlarged view of the dotted line portion P of FIG. 2(*a*);

DETAILED DESCRIPTION OF THE PREFERRED EMBODIMENTS

Preferred embodiments of the electronic part mounting device according to this invention will be explained in detail below by reference to the drawings.

Figure 1:
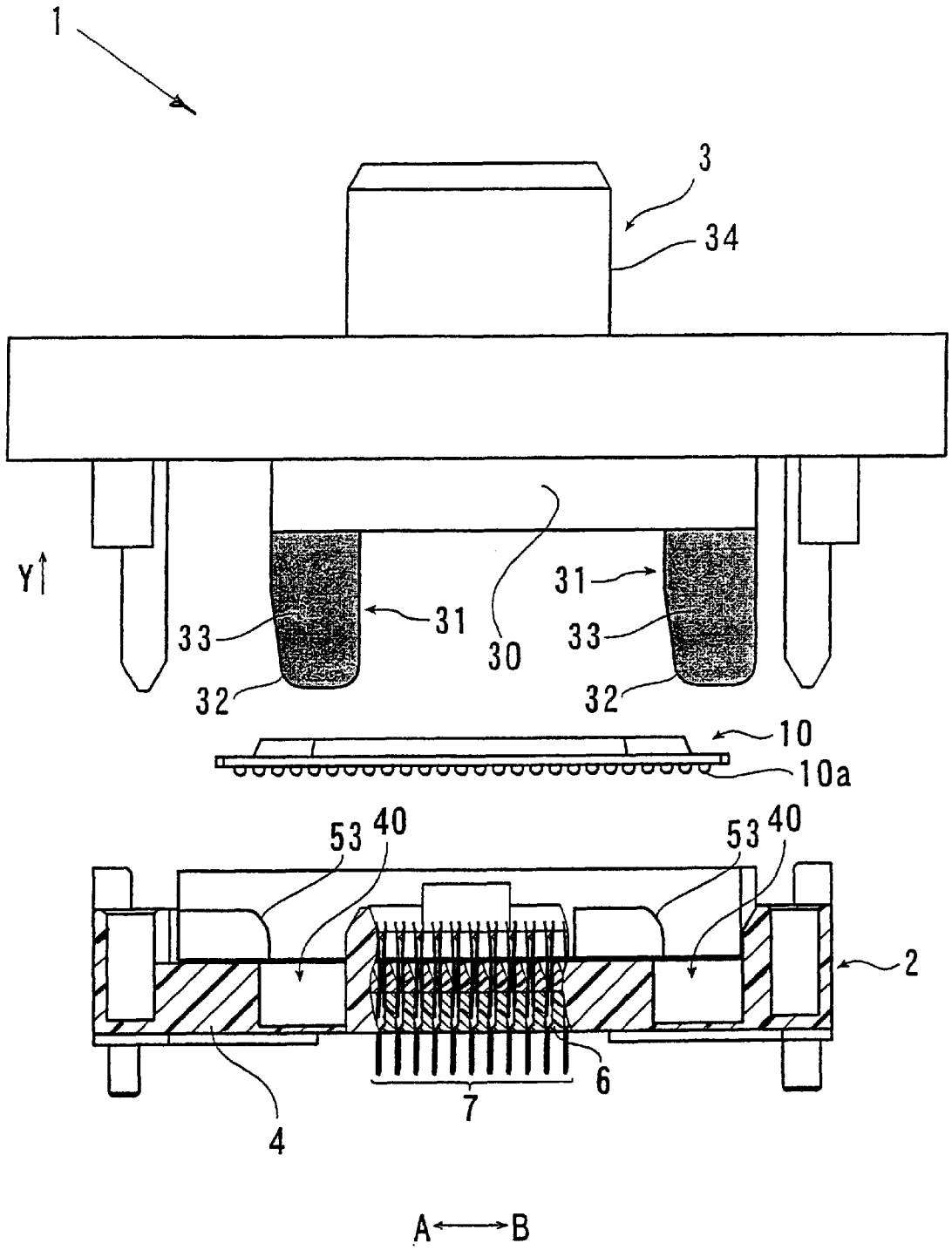
FIG. 1 is an exploded partial cross sectional view of a first embodiment of an electronic part mounting device according to this invention.

As shown in FIG. 1, there is provided an electronic part mounting device 1 of the present invention for the mounting of an electronic part 10 having connective terminals 10*a*, for example, in the form of solder balls being arranged according to a prescribed pattern. Electronic part mounting device or socket 1 has a main socket body 2 and a separate contact opening and closing tool member 3 adapted to work with main socket body 2.

Main socket body 2 has a base portion 4 and a contact part opening and closing slider member 5 which is provided on base 4. Both base 4 and slider member 5 are made typically from a resin material such as polyetherimide or the like.

Base 4 is adapted to be mounted on a wiring substrate such as a printed circuit board (not shown in the drawings).

An insert or stopper member 6 is provided at the center of base 4 and, in insert member 6, a large number of longitudinal contacts 7 are vertically fixed at preselected locations in conformity with the pattern of solder balls 10*a* of electronic part 10. Each contact 7 has preferably a pair of arm shaped contact parts 7*a* and 7*b* at one end, which are capable of elastically opening and closing.

Slider member 5 is so constructed as to be able to move in the opening and closing direction of arm 7*a* and 7*b* of contacts 7.

As is shown in FIGS. (2*a*) and 3, a carrying part 50 is provided on the periphery of the upper surface of slider 5. A positioning guide 51 is provided on the periphery of carrying part 50 for guiding package 10 and accurately positioning it at a prescribed location when it is mounted on socket body 2.

Figure 2A:
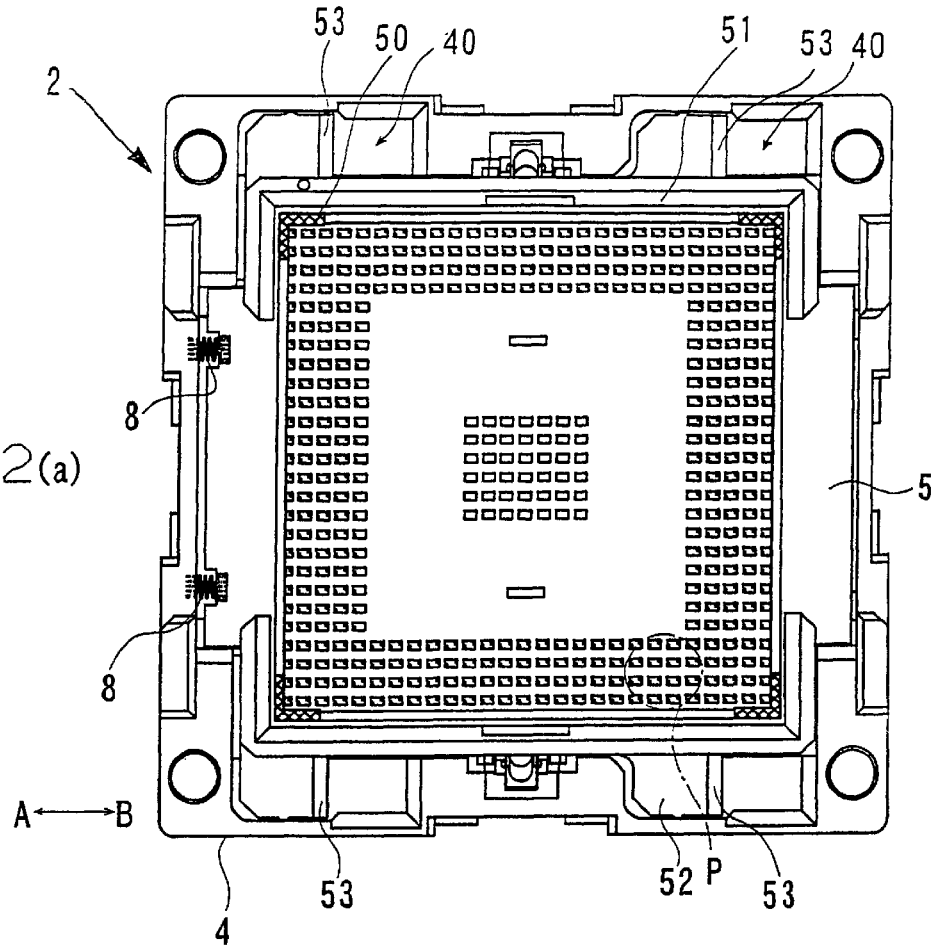
FIG. 2(*a*) is a top plan view of the main socket body of FIG. 1.
Figure 2B:
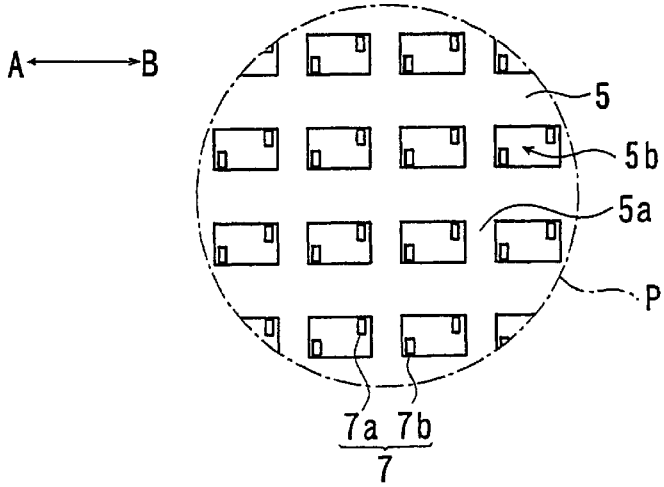

A plurality of through holes 5*b* are formed in slider 5 leaving a lattice-shaped structure with partition walls 5*a* which act as an engagement part for the contacts as will be described below. Each contact 7 described above is arranged with regard to through holes 5*b* so that a pair of arms 7*a*, 7*b* sandwich partition wall 5*a* of slider 5 with the tips of the arms sticking out from the top of slider 5 through the respective through hole 5*b* as shown in FIG. 2(*b*).

Figure 3:
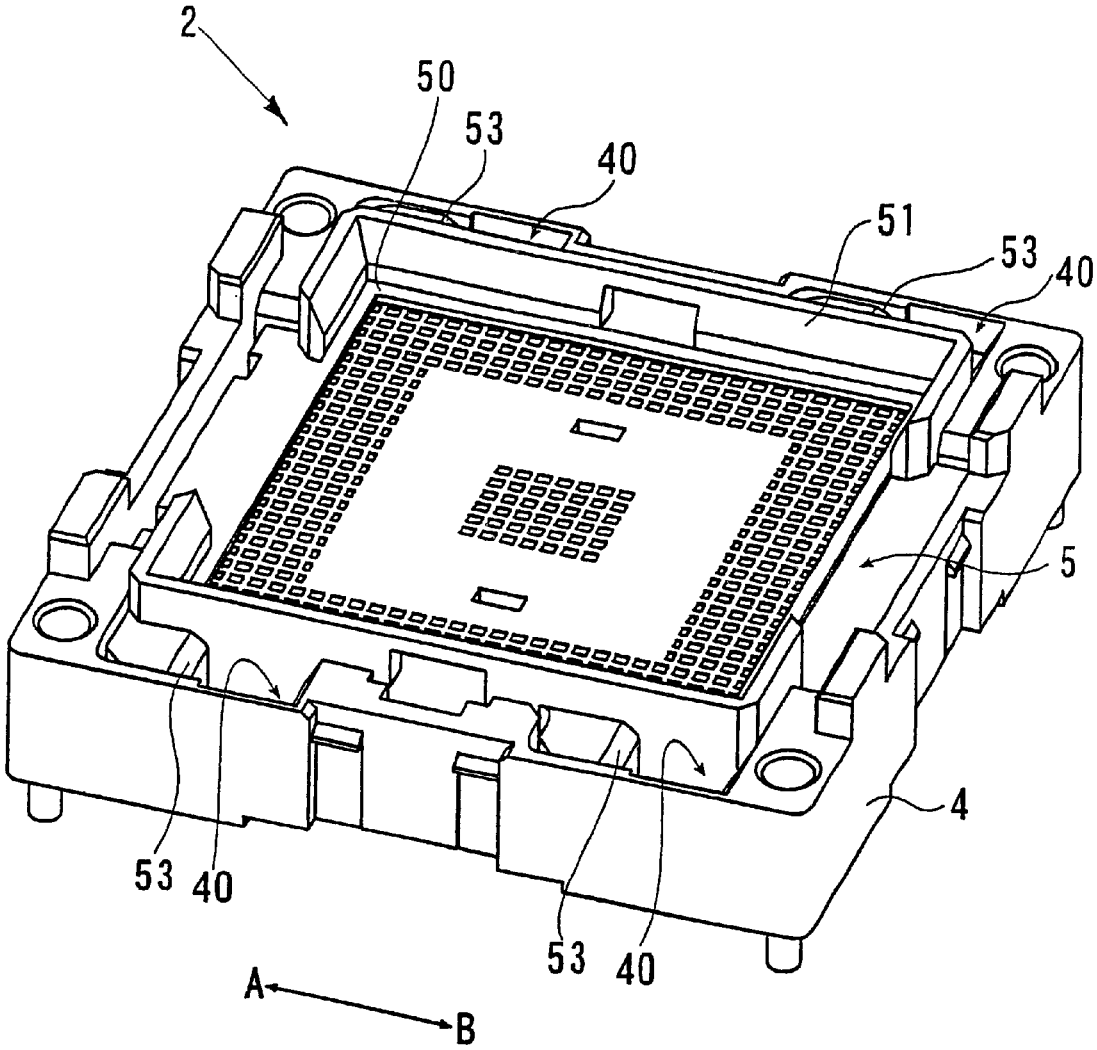
FIG. 3 is an oblique view of the main socket body of FIG. 1.

Slider 5 is adapted to be able to move in the direction indicated by arrow A-B which is the opening and closing direction of arms 7*a* and 7*b* of contact 7 as shown in FIG. 3.

In the state where no external force is applied to socket body 2, slider 5 is biased to the right (contact closed position) by a coil spring 8.

Socket body 2 has a plurality of tool positioning parts 52 positioned on the top surface of and part of slider 5 having engagement surface 53 positioned to be engaged by contact opening and closing tool 3 (as will be explained in detail below) to control the opening and closing of arms 7*a* and 7*b* of contact 7.

In this embodiment, engagement surface 53 is positioned on the right side (toward arrow B) of each tool positioning part 52 of slider 5. The engagement surface 53 is typically inclined at a preselected angle to control the opening and closing of arms 7*a* and 7*b* of contact 7. There is no special restrictions upon the angle of the incline of each engagement surface 53, provided it is greater than zero degrees and smaller than 90 degrees as compared with the opening and closing direction of arms 7*a* and 7*b* of contact 7. Moreover, engagement surface 53 can be formed with a curved surface along with its inclined surface.

On base 4, there is provided a plurality of cavities 40 of such size and depth to accommodate actuator part 30 of tool 3 as shown in FIG. 1 which will be described later.

In accordance with this invention, contact opening and closing tool 3 is provided to work with tool positioning part 52 and particularly engagement surface 53 to cause the movement of slider 5 in a back and forth direction as shown by arrows A, B in the figures.

As part of contact opening and closing tool 3, there is a holding part 34 which, for example, by the use of air suction holds/releases package 10 during loading and unloading of such package in main socket body 2. As mentioned above, contact opening and closing tool 3 has an actuator part 30 which is provided for the purpose of moving slider 5 on base 4.

Actuator part 30 is typically made of metal such as carbon steel, etc., and has a plurality (four in this example) of leg members 31 positioned to contact engagement surface 53 and sized to be partially received in cavities 40. At the end of each leg member 31 there is a touch portion having a slightly curved/angular part formed on one side so as to directly contact angled surface 53. The interaction of touch surface 32 of leg member 31 with engagement surface 53 of positioning part 52 causes the movement of slider 5.

Figure 4:
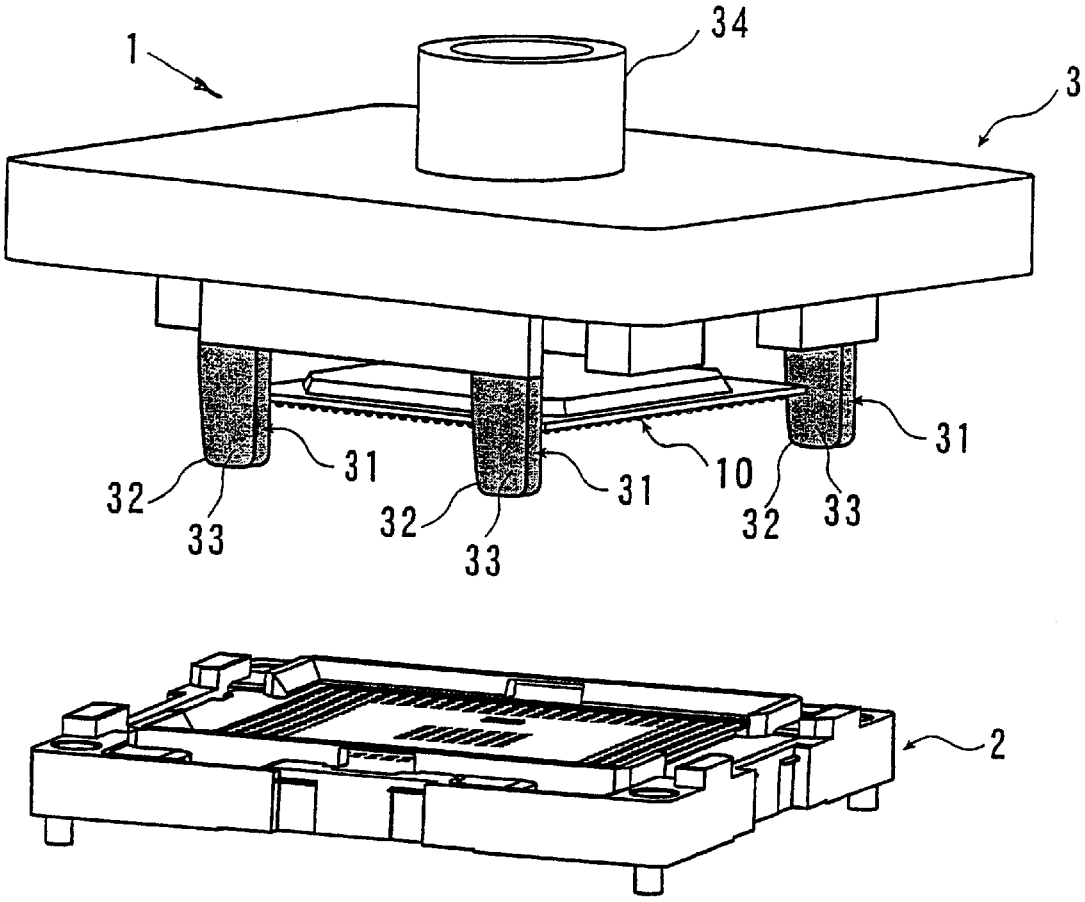
FIG. 4 is an oblique view of the electronic part mounting device of FIG. 1.

In an embodiment of this invention, leg member 31 has a lubrication layer 33 made preferably of a solid lubricating agent formed on it as depicted by shading in FIGS. 1 and 4. Examples of such lubricating agents are molybdenum disulfide or graphite. It has been found to be desirable to use graphite from the standpoint of increasing slidability under a large load. The thickness of the lubrication layer 33 is desirably in the range between 0.01 mm and 0.05 mm and, more preferably, the thickness of the lubrication layer is in the range between 0.02 mm and 0.04 mm.

If the thickness of the lubrication layer 33 happens to be less than 0.01 mm, such lubrication layer will tend to early failure in operation. If the thickness of the lubrication layer 33 happens to be more than 0.05 mm, on the other hand, such a lubrication layer 33 may tend to become fragile.

The electronic part mounting device 1 of the present invention operates as set forth below.

Upon contact opening and closing tool 3 being brought into contact with main socket body 2 and then pressed down in the Y direction, touch part 32 of each leg 31 engages corresponding engagement surface 53 of slider 5 with the consequence that slider 5 moves in the direction indicated as toward arrow A (to the left) at generally a right angle to direction Y. The movement of slider 5 causes partition wall 5*a* to correspondingly move arm 7*a* of each contact 7 to the left (open position). In this state, BGA package 10 is released from holding part 34 and placed on loading part 50 of slider 5 with each solder ball 10(*a*) of package 10 placed between arms 7*a* and 7*b* of each contact.

Upon the removal of tool 3 from contact with main socket body 2, slider 5 moves back to its original position and correspondingly arms 7*a* and 7*b* of the contacts move toward their closed position in which they compressively engage solder balls 10(*a*).

The package 10 can be removed by pressing down tool 3 so as to move slider 5 and open arms 7*a* and 7*b* of the contacts 7.

In an alternate embodiment of this invention, incorporating layer 33 on touch part 32 as described above, touch part 32 touches engagement surface 53 through lubrication layer 33. This lubrication layer greatly reduces the friction between touch part 32 and engagement surface 53. Accordingly, friction wear on these parts is minimized, thereby reducing the need for maintenance on electronic mounting device 1.

In accordance with this invention, the legs 31 of actuator 30 can be wedge-shaped which as they interact with surface 53 will affect the amount of opening of arms 7*a* and 7*b* of contact 7, depending on the amount of downward movement of such legs. Additionally, the amount of opening and closing of the arms can also be influenced by the bending of the wiring substrate that supports main socket body 2 and the amount of "play" in various parts of tool 3 and socket body 2.

Figure 5A:
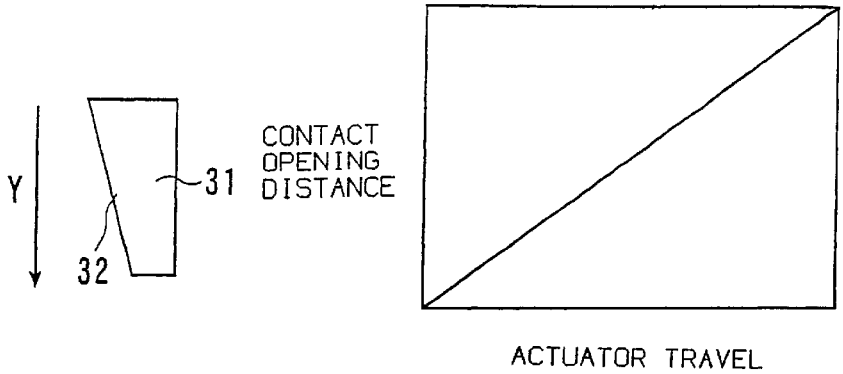
FIGS. 5(*a*) through 5(*c*) show graphs indicating the relationship between the shape of the angled surface of the positioning parts of a contact opening and closing tool of this invention and the amount of opening of the arms of the contact.
Figure 5B:
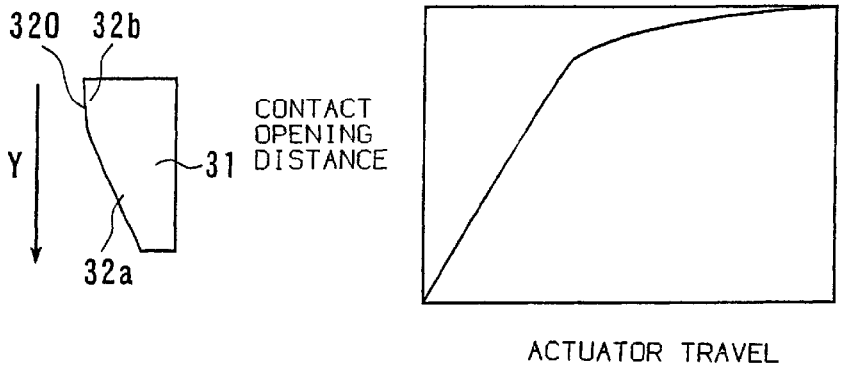
Figure 5C:
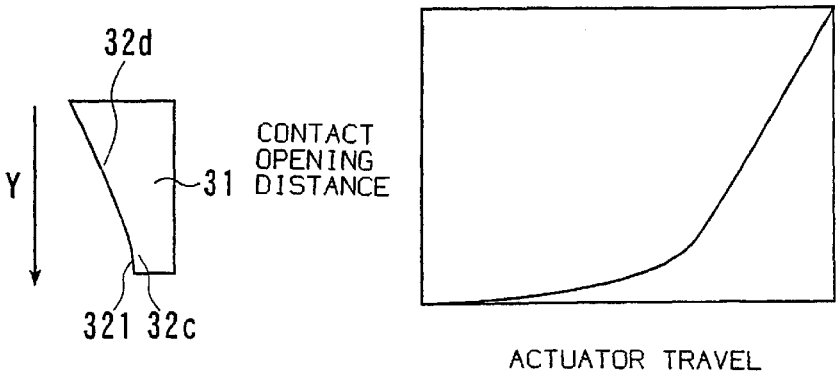

FIGS. 5(*a*) through 5(*c*) show different shaped touch parts 32 of leg 31 and graphs indicating the relationship between the shape of the touch parts and the amount of opening of the arms 7*a* and 7*b* of contact 7 caused by the engagement of such touch parts with surface 53.

As shown in FIG. 5(*a*), the contacting surface of touch part 32 of leg 31 is linear; and accordingly, there is a proportional relationship between the amount of downward movement of leg 31 in engagement with surface 53 and the amount of opening of arms 7*a* and 7*b* of contact 7 throughout the entire engagement stroke.

In FIG. 5(*b*), the contacting surface 320 of touch part 32 for engaging surface 53 is modified to provide a more inclined engagement surface with surface 53 (point 32*a*) initially and less near the end of the engagement stroke (point 32*b*) thereby causing a greater rate of contact opening at the first part of the downward stroke than at the end of the stroke.

On the other hand, in FIG. 5(*c*) the contact surface 321 of touch part 32 for engaging surface 53 is modified to provide a less inclined engagement with surface 53 (point 32*c*) initially than near the end of the engagement stroke (point 32*d*) thereby causing a lower rate of contact opening at the first part of the stroke than at the end.

The above described relationship makes it possible to adjust the amount of opening of the contacts against the amount of actuator part movement so as to best fit a specific application.

For example, in the case of FIG. 5(*b*) with touch part surface 320, the amount of movement of slider 5 is minimal with respect to movement of legs 31 at the end of the engagement stroke thereby reducing the amount of contact opening variation with varying length engagement strokes.

On the other hand, FIG. 5(*c*) with touch part 321, the amount of movement of slider 5 is minimal at the start of the engagement stroke thereby reducing the amount of contact opening at the beginning of the engagement stroke which can be useful where the wiring substrate that carries main socket body 2 is bent or where tool 3 has "play" in the direction of its movement.

Figure 6A:
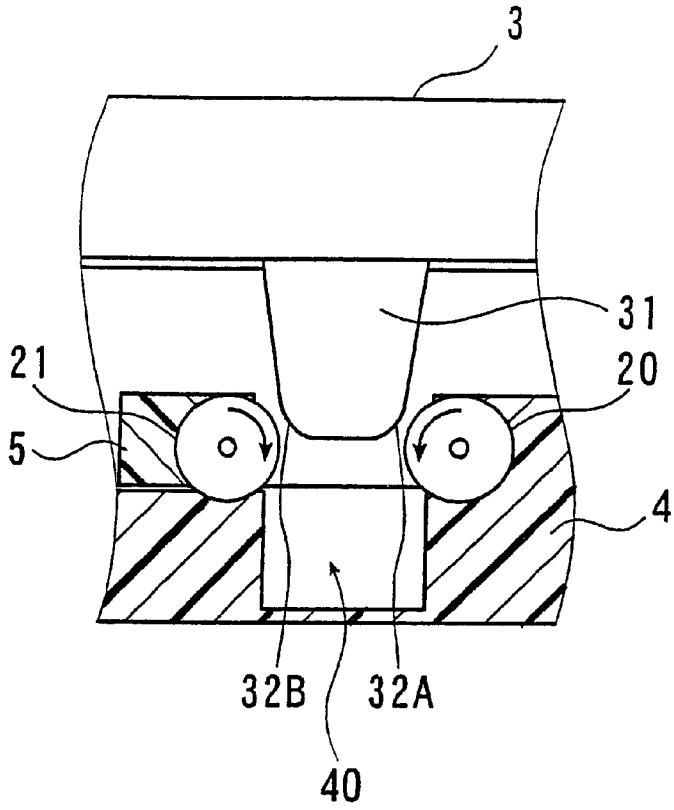
FIGS. 6(*a*) and 6(*b*) show partial cross sectional views of essential parts of alternative embodiments of this invention.
Figure 6B:
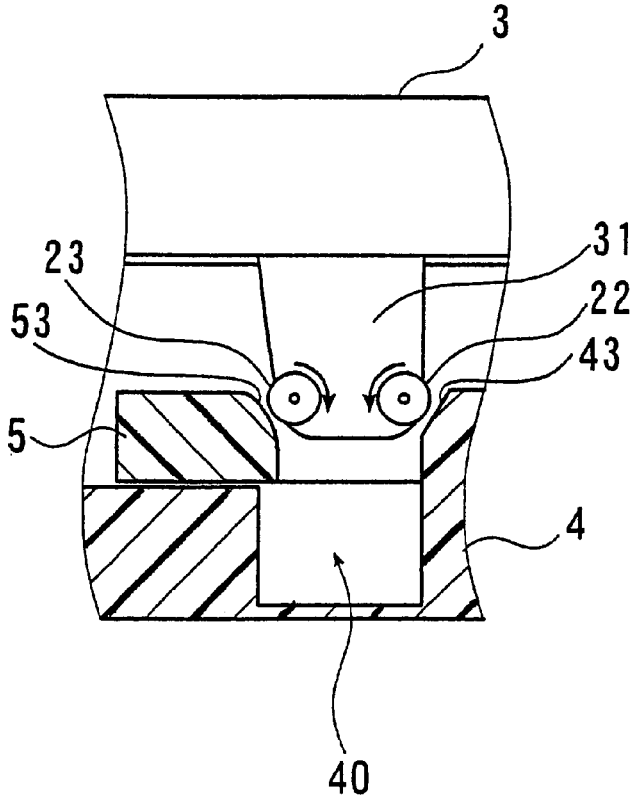
Figure 7A:
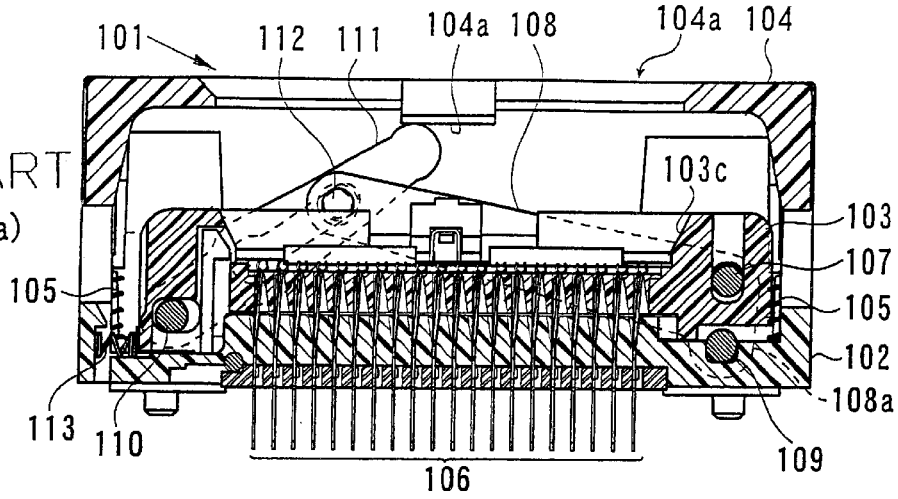
PRIOR ART FIG 7(a)
FIGS. 7(*a*) and 7(*b*) show cross sectional views of a prior art socket for the burn-in test.
Figure 7B:
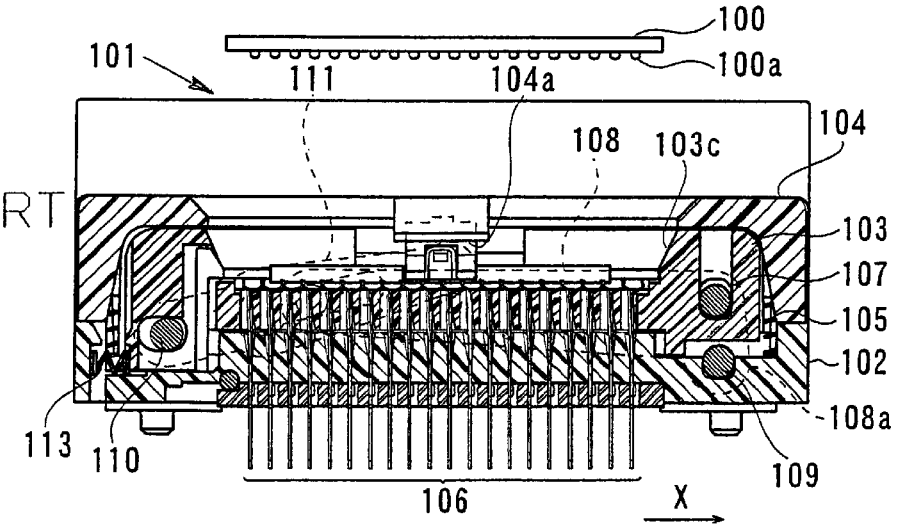
PRIOR ART FIG 7(b)

FIGS. 6(*a*) and 6(*b*) are partial cross section views of essential parts of other alternative embodiments of this invention. For the parts that are the same as earlier described embodiments, the same numerals will be used and their detailed explanations will be omitted.

As shown in FIG. 6(*a*), a pair of freely rotatable rollers 20 and 21 are provided generally at the opening of cavity 40 on base 4 of main socket body 2. Roller 20 is provided on the side of base 4 and other roller 21 is provided on the side of slider 5. These rollers are adapted to contact touch parts 32A and 32B on both sides of leg 31 of tool 3. Rollers 20 and 21 can be made from any wear resistant material of necessary strength such as carbon steel.

In another variation as shown in FIG. 6(*a*), a pair of freely rotatable rollers 22 and 23 are installed at the tip end of leg 31. In this embodiment, roller 22 contacts a tapered receiving part 43 that is formed on base 4 while other roller 23 contacts surface 53 of slider 5.

The use of these rollers reduces the friction between leg 31 of tool 3 and base 4 and slider 5 so that a small force is needed against tool 3 to open contacts 7. This feature is very useful for high contact count devices.

The preferred embodiments of this invention have been explained above by referring to the attached drawings. It is obvious that the scope of the invention is not intended to be limited to the specifics of what has been described in the above embodiments.

For example, engagement surface 53 of slider 5 is tilted at a prescribed angle against the opening and closing direction of the arms of contact 7. However, touch part 32 of leg 31 may similarly be inclined or an inclined part may be formed on both surface 53 and touch part 32.

Still further, this invention can be applied not only to sockets for the burn-in test but also to the sockets for various electrical property tests. It may also be used not only for BGA packages, but also various other packages including the PGA package, etc.

What is claimed:

1. A contact part opening and closing tool for use with a separate detached main socket body having a plurality of contact parts mounted therein for making contact with a plurality of terminals on an electronic part comprising a holding part for mounting and dismounting the electronic part in the main socket body and an actuator member having a touch part that engages and moves a receiving part on said socket body to cause opening and closing of said contact parts, said touch part having a lubrication layer thereon to minimize friction between it and the receiving part thereby extending the life of the tool and socket body.

2. The contact part opening and closing tool of claim 1 wherein said receiving part includes a contact part opening and closing member which moves with said receiving part in response to said receiving part being moved by said touch part, said contact part opening and closing member directly moving said contact parts between an open position for mounting and dismounting an electronic part and a closed position for engaging said terminal of an electronic part.

3. The contact part opening and closing tool of claim 2 wherein said touch part and said receiving part each have an engagement surface which come in contact with one another with the touch part engagement surface sliding along the receiving part engagement surface when moved along a contacting direction perpendicular to the main socket body, at least one of said engagement surfaces having an inclined surface with respect to said contacting direction.

4. A contact opening and closing tool of claim 3 wherein said inclined surface is configured to cause said contact parts to open more rapidly at the beginning of contacting between the engagement surfaces of the touch part and the receiving part during movement in the contacting direction than at the end of movement in the contacting direction of the contacting between the engagement surface of the touch part and the receiving part.

5. A contact opening and closing tool of claim 3 wherein said inclined surface is configured to cause said contact parts to open more slowly at the beginning of contacting between the engagement surfaces of the touch part and the receiving part during movement in the contacting direction than at the end of the movement in the contacting direction of the contacting between the engagement surface of the touch part and the receiving part.

6. A contact opening and closing tool of claim 1 wherein said actuator part has a plurality of touch parts.

7. A contact opening and closing tool of claim 1 wherein said lubrication layer is chosen from the group of molybdenum disulfide and graphite.

8. A contact opening and closing tool of claim 3 wherein said inclined surface is greater than 1° and less than 90°.

9. A contact opening and closing tool of claim 3 wherein said contact parts each have a pair of arms which move in a direction generally at a right angle to that of the contacting direction when moving between contact open and contact closed position.

10. An electronic part mounting device comprises a main socket body having a plurality of contact parts mounted therein for making contact with a plurality of contact terminals on an electric part and a separate contact part opening and closing tool not attached to the main socket body comprising a holding part for mounting and dismounting the electronic part in the main socket body and an actuator member having a touch part that engages and moves a receiving part on said socket body to cause opening and closing of said contact parts, said contact parts each have a pair of arms which move in a direction generally at a right angle to a movement direction of contact part opening and closing tool relative to the main socket body when moving between contact open and contact closed position.

11. An electronic part mounting device of claim 10 wherein said receiving part includes a contact part opening and closing member which moves with said receiving part in response to said receiving part being moved by said touch part, said contact part opening and closing member directly moving said contact parts between an open position for mounting and dismounting an electronic part and a closed position for engaging said terminal of an electronic part.

12. An electronic part mounting device of claim 11 wherein said touch part and said receiving part each have an engagement surface which come in contact with one another with the touch part engagement surface sliding along the receiving part engagement surface when moved along said movement direction, at least one of said engagement surfaces having an inclined surface with respect to said contacting direction.

13. An electronic part mounting device of claim 10 wherein said actuator part has a plurality of touch parts.

14. An electronic part mounting device of claim 10 wherein said touch part has a lubrication layer thereon to minimize friction between it and the receiving part.

15. An electronic part mounting device of claim 14 wherein said lubrication layer is chosen from the group of molybdenum disulfide and graphite.

16. An electronic part mounting device of claim 12 wherein said inclined surface is greater than 1° and less than 90°.

17. An electronic part mounting device comprises a main socket body having a plurality of contact parts mounted therein for making contact with a plurality of contact terminals on an electric part and a separate contact part opening and closing tooling not attached to the main socket body comprising a holding part for mounting and dismounting the electronic part in the main socket body and an actuator member having a touch part that rollingly engages and moves a receiving part on said socket body to cause opening and closing of said contact parts, said rolling engagement provided by roller means mounted on one of said touch part or said receiving part.

18. An electronic part mounting device of claim 17 wherein said roller means are wheel-shaped rotating members.

* * * * *